United States Patent [19]

Thoma

[11] Patent Number: 4,588,304

[45] Date of Patent: May 13, 1986

[54] PROGRAM CARRIER FOR SWITCHING CHRONOMETER SYSTEMS

[75] Inventor: Friedrich X. Thoma, Haslach, Fed. Rep. of Germany

[73] Assignee: Dieter Graesslin Feinwerktechnik, Fed. Rep. of Germany

[21] Appl. No.: 592,298

[22] Filed: Mar. 22, 1984

[30] Foreign Application Priority Data

Mar. 25, 1983 [DE] Fed. Rep. of Germany ..... 3310934

[51] Int. Cl.[4] ..... G04F 8/00

[52] U.S. Cl. ..... 368/107; 200/38 BA; 200/38 CA

[58] Field of Search ..... 368/107–109, 368/97, 98, 243, 244, 250, 252, 269; 200/38 CA, 38 BA, 38 A, 38 FB, 38 B, 38 C, 37 A; 74/568 T

[56] References Cited

U.S. PATENT DOCUMENTS 3,267,767 8/1966 Neal ..... 200/38 BA X 3,727,016 4/1973 Audley ..... 200/38 CA 4,351,200 9/1982 McElroy ..... 200/38 BA X

FOREIGN PATENT DOCUMENTS 2813069 9/1979 Fed. Rep. of Germany .

2935893 3/1980 Fed. Rep. of Germany ..... 200/38 BA 2845272 4/1980 Fed. Rep. of Germany ..... 200/38 BA

*Primary Examiner*—Vit W. Miska

*Attorney, Agent, or Firm*—Hill, Van Santen, Steadman & Simpson

[57] ABSTRACT

In a program carrier for switching chronometer means comprising a motor-driven drum which comprises a plurality of switch elements at its circumference that can be displaced between an active and an inactive position and which interact with a sampler in their active position for the control of a switch, the switch elements are integrally connected to the drum via movable arms.

15 Claims, 5 Drawing Figures

FIG. 3
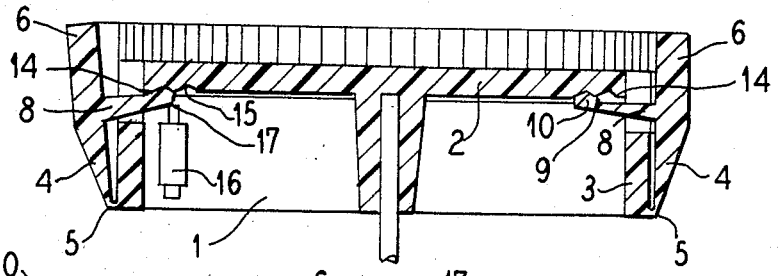
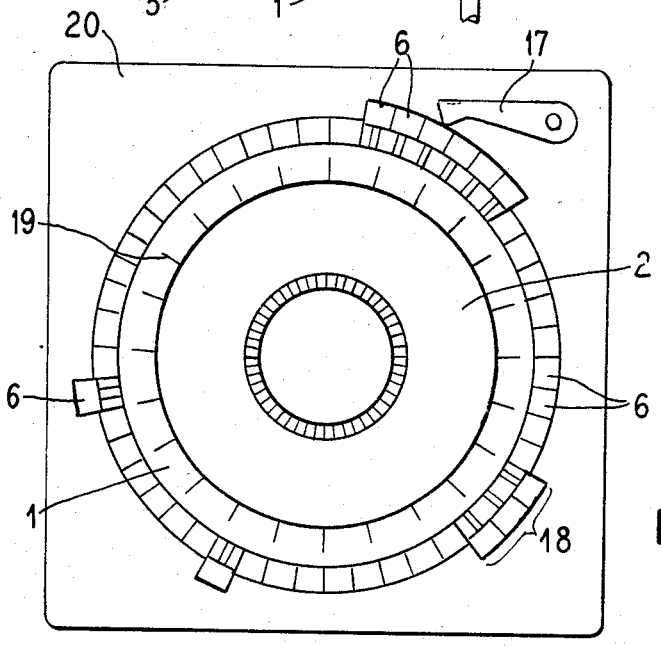
FIG. 4
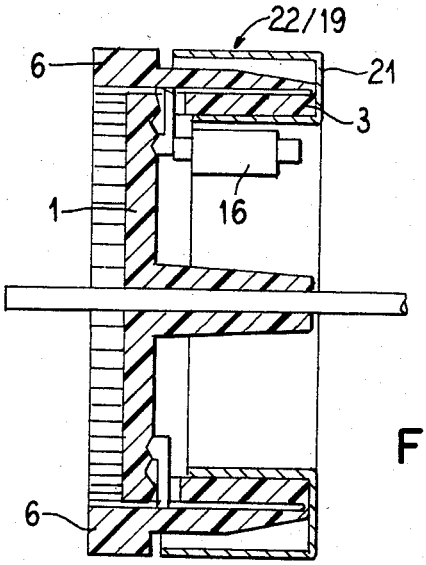
FIG. 5

PROGRAM CARRIER FOR SWITCHING CHRONOMETER SYSTEMS

BACKGROUND OF THE INVENTION

The invention relates to a program carrier for switching chronometer systems having a motor driven drum which comprises a plurality of switch elements at its circumference which can be displaced between an active and an inactive position, and which interact with a sampler in their active position for the control of a switch.

Given a known switching chronometer system, an electrical switch clock of the type initially described (see German Letters Pat. No. 28 13 069, incorporated herein by reference), the program carrier comprises at least two parts seated and fixed relative to one another, a motor driven drum, and an index plate plugged onto the drum and in engagement therewith. For this purpose, the generated surface of the drum is provided with guide slots that are open at one end and extend in the direction of the drum axis in radially proceeding manner, and with movable arms of switch elements interengaging into said guide slots. Here, the switch elements are united via the movable arms to form a one-piece index plate.

This mechanism has associated with it the considerable disadvantage that the manufacturing tolerances of the individual, movable arms and of the switch elements in engagement with the generated surface of the drum which are disposed there must be extremely precise with respect to the outside diameter of the generated surface of the drum. This is true in order to assure the desired effect of having two secured switch positions of the individual switch elements on the generated surface of the drum.

SUMMARY OF THE INVENTION

An object of the invention is to create a program carrier of the type initially cited which does not have these disadvantages and which can be simply, rationally, and economically manufactured and assembled and whose switch elements not only function independently of one another but also enable reproducibly secured switch positions.

This object is achieved in that the switch elements are integrally connected to the drum via movable arms. The program carrier according to the invention is manufactured of a plastic.

BRIEF DESCRIPTION OF THE DRAWINGS

FIG. 3 is a sectional view through a program carrier assembled in conformity with its function and having a vertically seated program carrier axis shaft;

FIG. 4 is a plan view of a program carrier according to FIG. 3; and

FIG. 5 is a sectional view through a program carrier mounted or assembled and positioned in conformity with its function and having a horizontally seated program carrier axis shaft.

DESCRIPTION OF THE PREFERRED EMBODIMENTS

Figure 1:
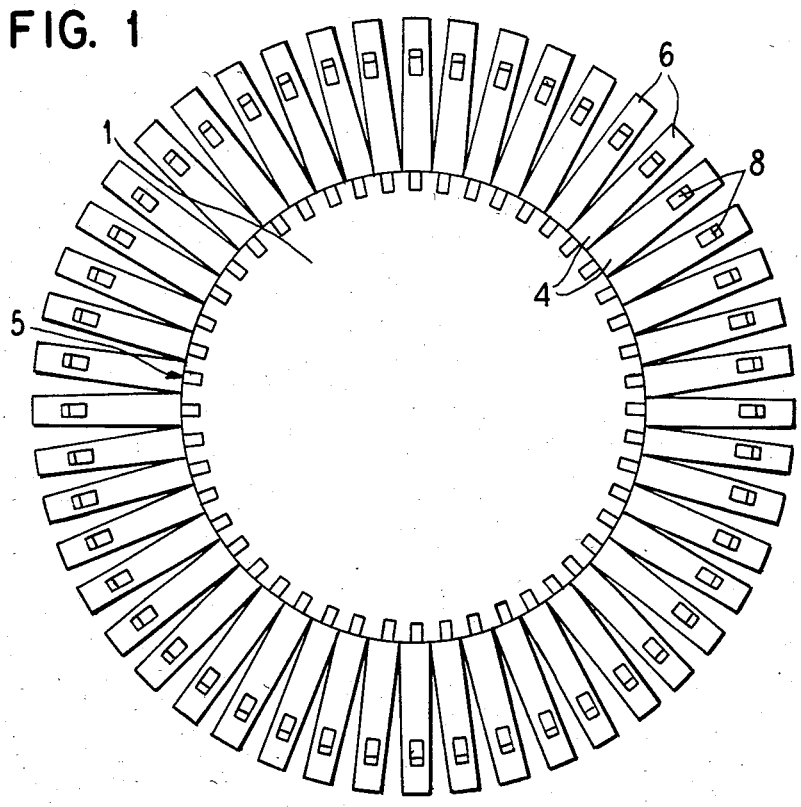
FIG. 1 is a schematic view of a plastic injection molded part of a program carrier according to the invention shown in a shape corresponding to the part as ejected from the injection molding tool.

FIG. 1 shows a program carrier comprising a single-piece plastic part which essentially comprises a drum 1 having a floor 2 and a generated surface 3, whereby movable arms 4 proceeding radially toward the outside are disposed there at the free end of the generated surface 3, particularly at a right angle relative to the generated surface 3. These arms 4 are materially connected via a joint 5 to the generated surface 3, and thus to the drum 1. At their free ends, the arms 4 are provided with switch elements 6, i.e. the movable arms 4 can act directly as switch elements 6.

As may be seen more clearly in one of the following figures, the arms 4 are upwardly pivotable by 90° in conformity with the program. Reference numeral 8 indicates index latches on each arm 4 or switch element 6. These index latches 8 are provided both with a stop nose 9 as well as with a latch cam 10 for engagement in conformity with their function with cooperating latch elements 11 which are disposed in the region of the floor 2, as the following figures show in greater detail.

Figure 2:
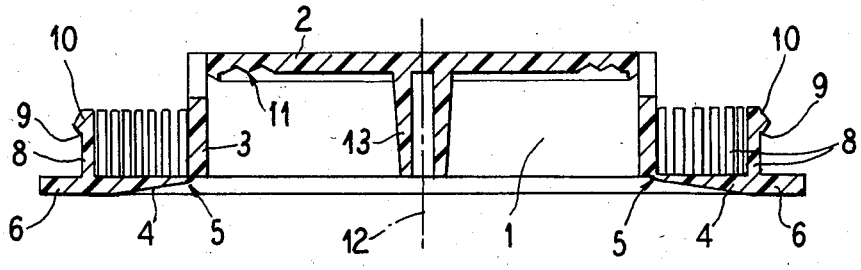
FIG. 2 is a sectional view through the injection molded part of FIG. 1.

In a sectional view, FIG. 2 shows the particular design of the injection molded part, particularly in the area of the joints 5 as well as in the area of the index latches 8 and the corresponding cooperating latch element 11.

The present example of the injection molded part shows the relatively simple manufacture of such a program carrier by molding. The material connection of the arms 4 and switch elements 6 to the generated surface 3 of the drum 1 in the area of the joints 5 thus guarantees a connection that has proven itself in plastics technology, particularly since this joint 5 is not significantly stressed in the engagement of the arms 4 in conformity with the functioning of the unit. A bearing flange or a bearing bush 13 for the seating of the program carrier is provided in coaxial fashion to the axis 12 of the drum 1.

FIG. 3 shows the program carrier mounted in conformity with its function. The movable arms 4 comprising the switch elements 6 have been manually or mechanically pivoted up such that the index latches 8, particularly the stop nose 9 at each arm 4, engage behind the latch edge 14 in the region of the upper sector of the generated surface. The generated surface 3 is provided with passages there for the entry of the index latches 8. Latch grooves 15 into which the latch cams 10 of the arms 4 can be engaged in conformity with the program are annularly provided in the inner region of the floor 2. The latch grooves 15 together with the latch cams 10 guarantee the two possible, mutually radially different switch positions of the arms 4, and thus of the switch elements 6. The sensing of the switch elements 6 can thus occur at the outer circumference, as one of the following figures also shows. It is also provided, however, that the sensing of the respective switch position of a switch element 6 can also occur directly at the index latches 8 in the inside of the drum 1, as shown by the switch 16 having a sampler 17 which is disposed there.

FIG. 4 clearly shows the possible programmability of the switch elements 6 which can be individually pivoted in or out, or a so-called switch track can be formed comprising a plurality of switch elements 6 pivoted out or in. Such a switch track 18 can be sampled by an outer sampler or by a sampler 17 disposed in the inside of the drum 1 for the control of a switch, particularly an electric switch. This is not shown in detail. Reference numeral 19 denotes a setting scale on the upper side of the floor 2 of the drum 1. As a result of its switch elements 6 that are spatially relatively narrow and disposed in close proximity to one another, such a program carrier permits a high resolution switching program with relatively short switching time intervals between two switch elements 6 programmed relative to one another in conformity with the switching programs. Such a program carrier can be employed in a switch clock. Reference numeral 20 shows such a housing in a plan view.

In FIG. 5, the above-described program carrier is horizontally seated, as is frequency required in so-called distributing switch clocks. The sensing of the programmed switch elements can then again occur in the inside of the drum 1. It is thus guaranteed that, given a particular viewing attitude, particularly of a setting scale 19, the sensing can be placed immediately therebehind so that it is not necessary to provide a separate setting scale and a readout scale such as required given the execution of the initially described, known switch clock.

In a further development of the invention, it thus becomes possible given such an execution and disposition of a program carrier that an annular setting or indexing scale part 21 is provided which, in particular, exhibits a U-shaped cross-section and which is mounted proceeding from the open side of the drum 1 and presses against the inside circumference of the generated surface 3, i.e. is plugged onto the drum. A setting or indexing scale can be positioned on the outside generated surface 22 of the part 21.

According to the invention, the program carrier can also have some other shape. Particularly, the length of the arms 4 or the switch elements 6 can be relatively short so that, in the broadest sense, it is finally no longer a drum but only a disk that is present as the carrier of the switch elements 6.

Also, it is envisioned to turn the drum 1 by 180° with respect to the joints disposed there with a material lock, so that the joints 5 of the arms 4 are positioned in the region of the juncture of the floor 2 with the generated surface 3 at the outside generated surface thereof. In this case, the index latches 8 would engage over the edge of the generated surface 3.

What is here meant by the initially cited active or inactive position is that a specific effect initiated by the sampler occurs in the one position of a switch element, whereas this effect does not occur in the other position of the switch element. This, however, does not exclude a different effect from occurring in the inactive position, as in the case, for instance, given the control of an electric selective switch.

It is within the framework of the invention that such a program carrier according to the invention can instead of plastic, also be manufactured from a metal sheet by punching and drawing technology with the same production-oriented and assembly-oriented advantages.

The economy of the present program carrier over the embodiments of the prior art is clear. The program carrier of the invention can be employed without restriction in known switching chronometer systems.

Although various minor changes and modifications might be proposed by those skilled in the art, it will be understood that I wish to include within the claims of the patent warranted hereon all such changes and modifications as reasonably come within my contribution to the art.

I claim as my invention:

1. In a program carrier for use in a switching chronometer system and wherein the program carrier comprises a motor-driven drum which has a plurality of switch elements at its circumference which can be displaced between an active and an inactive position and which interact with a sampler in their active position for the control of a switch, wherein the improvement comprises: said switch elements being integrally connected to said drum so as to form a single part and comprising radially outwardly extending arms connected to a periphery of the drum at a flexible integral joint; and first engagement means at a radially outer free end of each arm for engagement with second engagement means on the drum such that each arm may be variably positioned along a radial line from the center of the drum to the outer end of each corresponding arm.

2. A program carrier according to claim 1 wherein the integral joint is provided at a junction point of said switch element movable arms and a generated surface sidewall of said drum and being of the same material as said arms and drum.

3. A program carrier according to claim 2 wherein said joint is a thin-walled material skin.

4. A program carrier according to claim 1 wherein the switch element arms are positioned at an angle of 90° to the floor portion of the drum when the drum integral arms are assembled with the first engagement means engaging the second engagement means.

5. A program carrier according to claim 1 wherein index latches are provided on the arms and said index latches being dimensioned for engagement with cooperating latch grooves on a floor portion of the drum.

6. A program carrier according to claim 5 wherein said index latches are provided with a stop nose and with a latch cam; said stop nose being dimensioned to engage behind a latch edge on the drum for securing in an operating position, and bistable switch positions of the switch elements being determined by engagement with one of two latch grooves in the drum.

7. In a program carrier for use in a switching chronometer system and wherein the program carrier comprises a motor-driven drum which has a plurality of switch elements at its circumference which can be displaced between an active and an inactive position and which interact with a sampler in their active position for the control of a switch, wherein the improvement comprises:

said switch elements being integrally connected to said drum via movable arms;

index latches on the arms and said index latches being dimensioned for engagement with cooperating latch grooves on the drum; and a sensing means provided at the index latches in an inside of the drum for sensing a position of the switch elements.

8. A program carrier according to claim 1 wherein sensing means for the switch positions of the switch elements is provided directly at an outer circumference of said switch elements so as to detect a latched position of the same.

9. A program carrier according to claim 1 wherein an annular setting or indexing scale having a U-shaped cross-section is in engagement with an inner circumference of a major surface of the drum given a horizontally seated program carrier.

10. A program carrier according to claim 1 wherein said program carrier is manufactured of a plastic.

11. A program carrier according to claim 1 wherein said program carrier is punched and drawn from metallic sheet.

12. A switching chronometer system, comprising:

a motor driven program carrier forming a single molded part and having a circular central portion, a peripheral generated surface, and radially outwardly extending movable arms from said generated surface forming switch elements at a circumference of the program carrier;

said movable arms comprising a same material as a central portion of the program carrier and being integrally connected at a joint formed by a thin-walled portion of said material;

said movable arms having latch means at a free end thereof for selective engagement with one of two latch grooves in the central portion of the program carrier interiorly of the generated surface, one of the latch grooves corresponding to an inactive position for the switch element and the other groove corresponding to an active position of the switch element such that each arm may be variably positioned along a radial line from the center of the drum to the outer end of each corresponding arm; and means for detecting a position of the switch element depending upon which latch groove the switch element is latched to, said sensing means being utilized in the chronometer for electrical switching.

13. A switching chronometer system, comprising:

a motor driven program carrier having a circular central portion and radially extending movable arms forming switch elements at a circumference of the program carrier;

said movable arms comprising a same material as a central portion of the program carrier and being integrally connected at a joint formed by a thin-walled portion of said material;

said movable arms having latch means for selective engagement with one of two latch grooves in the central portion of the program carrier, one of the latch grooves corresponding to an inactive position for the switch element and the other groove corresponding to an active position of the switch element;

means for detecting a position of the switch element depending upon which latch groove the switch element is latched to, said sensing means being utilized in the chronometer for electrical switching; and the central portion being drum-shaped and in an inside surface of a floor portion of the drum, said two latch grooves being provided, and said latch means projecting substantially perpendicularly relative to a longitudinal radial direction of said movable arm.

14. A program carrier for use in a switching chronometer system, comprising:

a one-piece molded part forming a circular central portion with a surrounding generated surface and integral radially extending movable arms extending from said generated surface useful as switching elements, said movable arms being integrally attached by a joint of a same material as said generated surface, central portion, and the arms, and comprising a thin-walled portion; and a latch means in conjunction with the movable arm for engagement with cooperating groove means at said central portion such that each arm may be variably positioned along a radial line from the center of the drum to the outer end of each corresponding arm.

15. A switching chronometer program carrier comprising:

a drum having a floor portion and circular side wall depending therefrom at one end, and said side wall having an opposite free end;

a plurality of switch elements in the form of arms extending radially outwardly from a top portion of said side wall opposite the floor portion, said arms being connected by a flexible joint to the side walls at said opposite free end;

a latch means projecting from each of the arms; and engagement means on the drum for receiving the latch means, said engagement means and latch means permitting the arms to be radially variably positionable such that each arm may be varialby positioned along a radial line from the center of the drum to the outer end of each corresponding arm.

* * * * *